US007579779B2

(12) United States Patent
Andrews

(10) Patent No.: US 7,579,779 B2
(45) Date of Patent: Aug. 25, 2009

(54) PIVOTABLE MAGNETIC ASSEMBLY FOR ALLOWING INSERTION OR REMOVAL OF A LINEAR BEAM TUBE

(75) Inventor: Stuart William Andrews, Langham Colchester (GB)

(73) Assignee: E2V Technologies (UK) Limited, Chelmsford (GB)

( * ) Notice: Subject to any disclaimer, the term of this patent is extended or adjusted under 35 U.S.C. 154(b) by 572 days.

(21) Appl. No.: 11/352,404

(22) Filed: Feb. 13, 2006

(65) Prior Publication Data

US 2006/0181186 A1 Aug. 17, 2006

(30) Foreign Application Priority Data

Feb. 11, 2005 (GB) ..... 0502921.0

(51) Int. Cl.
*H01J 23/087* (2006.01)
*H01J 25/04* (2006.01)

(52) U.S. Cl. ..... 315/5.35; 315/5.37

(58) Field of Classification Search ..... 315/5.35, 315/5.37, 5

See application file for complete search history.

(56) References Cited

U.S. PATENT DOCUMENTS 3,076,116 A * 1/1963 Drieschman et al. ..... 315/5.35
3,259,790 A * 7/1966 Goldfinger ..... 315/5
5,504,393 A 4/1996 Kirshner
2004/0227468 A1 11/2004 Sadwick et al.

FOREIGN PATENT DOCUMENTS

| | | |
|---|---|---|
| GB | 843662 A | 8/1960 |
| GB | 853668 A | 11/1960 |
| GB | 892681 A | 3/1962 |
| GB | 923649 A | 4/1963 |
| GB | 927471 A | 5/1963 |
| JP | 62-295336 A | 12/1987 |

OTHER PUBLICATIONS

Great Britain Search Report dated May 13, 2005, issued in Application No. GB0502921.0.

* cited by examiner

*Primary Examiner*—Benny T. Lee
(74) *Attorney, Agent, or Firm*—Venable LLP; Robert Kinberg; Kyle D. Petaja

(57) ABSTRACT

An electron beam tube device has a magnetic frame with the top part being pivotable so as to pivot from a closed position in which the top part, including an electromagnetic coil covers the electron beam tube to an open position in which the electron beam tube is uncovered. This allows electron beam tubes with either large parts or integral parts such as output feeders to be removed from the magnetic frame without complete removal of the top plate.

13 Claims, 6 Drawing Sheets

PIVOTABLE MAGNETIC ASSEMBLY FOR ALLOWING INSERTION OR REMOVAL OF A LINEAR BEAM TUBE

CROSS-REFERENCE TO RELATED APPLICATION

This application claims the priority of British Patent Application No. 0502921.0 filed on Feb. 11, 2005, the subject matter of which is incorporated herein by reference.

BACKGROUND OF THE INVENTION

The present invention relates to a magnetic assembly for linear beam tube devices, in particular, for electron beam tube devices such as those known as Inductive Output Tubes (IOTs).

Linear beam tube devices such as electron beam tube devices are used for the amplification of RF signals. There are various types of linear electron beam tube device known to those skilled in the art, two examples of which are the klystron and the Inductive Output Tube (IOT). Linear electron beam tubes incorporate an electron gun for the generation of an electron beam of an appropriate power. The electron gun includes a cathode heated to a high temperature so that the application of an electric field between the cathode and an anode results in the emission of electrons. Typically, the anode is held at ground potential and the cathode at a large negative potential of the order of tens of kilovolts.

Electron beam tube devices used as amplifiers broadly comprise three sections. An electron gun generates an electron beam, which is modulated by application of an input signal. The electron beam then passes into a second section known as the interaction region, which is a cavity arrangement including an output cavity arrangement from which the amplified signal is extracted. The third stage is a collector, which collects the spent electron beam.

In an inductive output tube (IOT) a grid is placed close to and in front of the cathode, and the RF signal to be amplified is applied between the cathode and the grid so that the electron beam generated in the gun is density modulated. The density modulated electron beam is directed through an RF interaction region, which includes one or more resonant cavities, including an output cavity arrangement. The beam is focused by a magnetic means, typically electromagnetic coils, to ensure that it passes through the RF region and delivers power at an output section, within the interaction region, where the amplified RF signal is extracted. After passing through the output section, the beam enters the collector where it is collected and the remaining power is dissipated.

The difference between an IOT and a Klystron is that in an IOT, the RF input signal is applied between a cathode and a grid close to the front of the cathode. This causes density modulation of the electron beam. In contrast, a klystron velocity modulates an electron beam, which then enters a drift space in which electrons that have been speeded up catch up with electrons that have been slowed down. The bunches are thus formed in the drift space, rather than in the gun region itself.

The inventor appreciated that different applications of electron beam devices place different constraints on the physical arrangements of such devices. One application of an IOT, for example, is as a continuous wave amplifier in a synchrotron. In such applications, the frequency of operation can be substantially fixed allowing use of a robust form of output cavity known as an integral output cavity. However, such integral designs place different constraints in terms of assembly or disassembly of the device due to the fact that components such as a fixed output are unable to pass other components such as parts of the magnetic circuit.

The inventor appreciated the need for ease of assembly, disassembly and re-assembly of electron beam tube devices, in particular those having component parts of a cavity arrangement that are large or which are not easily removable.

SUMMARY OF THE INVENTION

The invention is defined in the claims to which reference is now directed.

The invention resides in a magnetic assembly for a linear beam tube device in which a part of the magnetic assembly is pivotably attached to allow that part to be moved to allow removal of a linear beam tube without complete removal of the part of the magnetic assembly. This simplifies removal of a linear beam tube incorporating a cavity arrangement that is too large to pass through the part of the magnetic assembly while ensuring that the part of the magnetic assembly can be replaced in exact registration with the remainder of the magnetic assembly. Preferably, the part that is pivotably attached is the top plate of the device with associated magnetic coil.

On a linear beam tube incorporating a fixed output feeder assembly, mounted orthogonally to the axis of the tube, the inventor appreciated that it is difficult to install or remove the tube from its associated magnetic circuit assembly without dismantling some part of the circuit assembly.

The present invention provides a mechanism whereby those parts of the circuit assembly that would otherwise prevent convenient tube extraction or installation, are pivoted off axis thus allowing access.

BRIEF DESCRIPTION OF THE DRAWINGS

An embodiment of the invention in the various aspects noted above will now be described with reference to the figures in which.

DETAILED DESCRIPTION OF THE INVENTION

The embodiment of the invention described is an Inductive Output Tube (IOT). However, it would be appreciated to the skilled person that the invention applies equally to other linear beam devices such as travelling wave tubes and Klystrons.

The embodiment of the present invention addresses the problems associated with the installation or removal of linear beam tubes containing integral output cavities and feeders, (or sidearms), from their associated circuit assemblies. This is achieved by pivoting those parts of the circuit assembly, that would otherwise cause unwanted particles to accumulate on the tube feeder, out of the path of the tube for the duration of the installation or removal process.

The embodiment of the present invention avoids the possible need to break electrical connections, and makes tube installation/extraction a one man process while also ensuring that the magnetic axis and precision of the magnetic frame is not compromised by the complete removal of major components.

A typical linear beam tube circuit assembly contains a magnetic frame to provide an axial DC magnetic field derived from a plurality of electromagnetic coils, through which at least a portion of the linear beam tube must usually pass. The inclusion of an orthogonal feeder prevents the tube from extending past the top most coil. This coil, (and its associated ironwork), must therefore be removed for tube installation or removal. In the present embodiment of the invention, the coil and ironwork are hinged to the remainder of the circuit assembly and can be swung out of the path of the linear beam tube as necessary.

Figure 1:
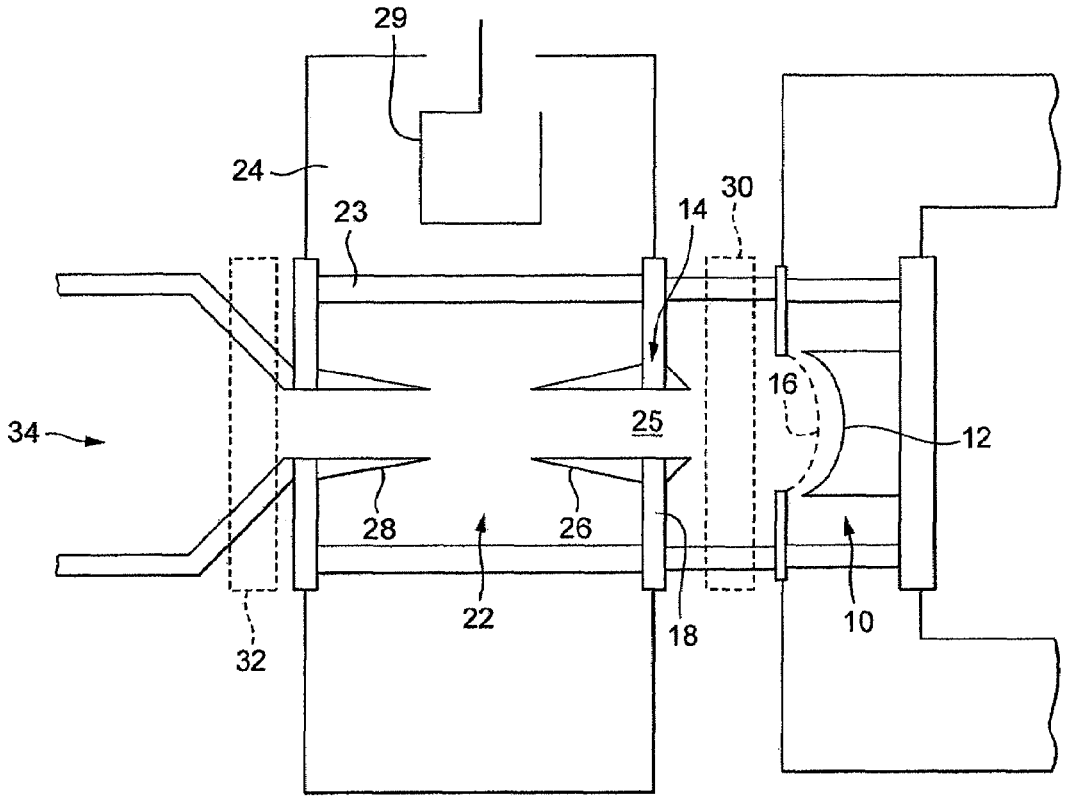
FIG. 1 (PRIOR ART)
FIG. 1: shows a schematic diagram of an Inductive Output Tube incorporating an external output cavity arrangement.

An IOT, as is known in the art, is first described and shown in FIG. 1. The IOT comprises an electron gun 10 for generating an electron beam. The electron beam is created from a heated cathode 12 held at a negative beam potential of around −36 kV and accelerated towards and through an aperture in a grounded anode 14 formed as part of a first portion of a drift tube 22 described later. In normal use, the electron gun 10 is located in the position illustrated in FIG. 1.

A grid 16 is located close to and in front of the cathode and has a DC bias voltage of around −80 volts relative to the cathode potential applied so that, with no RF drive a current of around 500 mA flows. The grid itself is clamped in place in front of the cathode (supported on a metal cylinder) and isolated from the cathode by a ceramic insulator, which also forms part of the vacuum envelope. The RF input signal is provided on an input transmission line between the cathode and grid. The electron gun 10 is coupled to a drift tube or interaction region 22 and output cavity 24 by a metallic pole piece 18.

The electron beam generated by the electron gun 10, is then density modulated by the RF input signal between cathode 12 and grid 16, and is accelerated by the high voltage difference (of the order 30 kV) between the cathode 12 and anode 14 and accelerates into a drift tube 22. The drift tube 22 is defined as a first drift tube portion 26 and a second drift tube portion 28 surrounded by an RF cavity 24 having a wall including a ceramic wall 23 forming part of the vacuum enclosure with the electron gun and collector assembly. The electron beams passes through a central aperture 25 in the first drift tube portion 26 having a generally disc shaped portion attached to or comprising the pole piece 18 and a frustoconical section. The whole drift tube, (or interaction region), 22 is located within a focussing magnetic field created by an upper coil 30 and lower coil 32 shown in dashed line. This creates a magnetic field along the length of the drift tube. The magnetic field has a return path through a magnetic frame (described later). The drift tube is typically made of copper. Connected to the drift tube section 22 is an output cavity 24 containing an output loop 29 through which RF energy in the drift tube section 22 couples and is extracted from the IOT. This type of output cavity is an external output in the sense that the cavity 24 does not form part of the vacuum envelope defined, in part, by the ceramic window or wall 23.

The electron beam having passed through the drift space and output region 28 still has considerable energy, the full beam voltage being typically 30 kV below ground. It is the purpose of the collector stage 34 to collect this energy.

Figure 2:
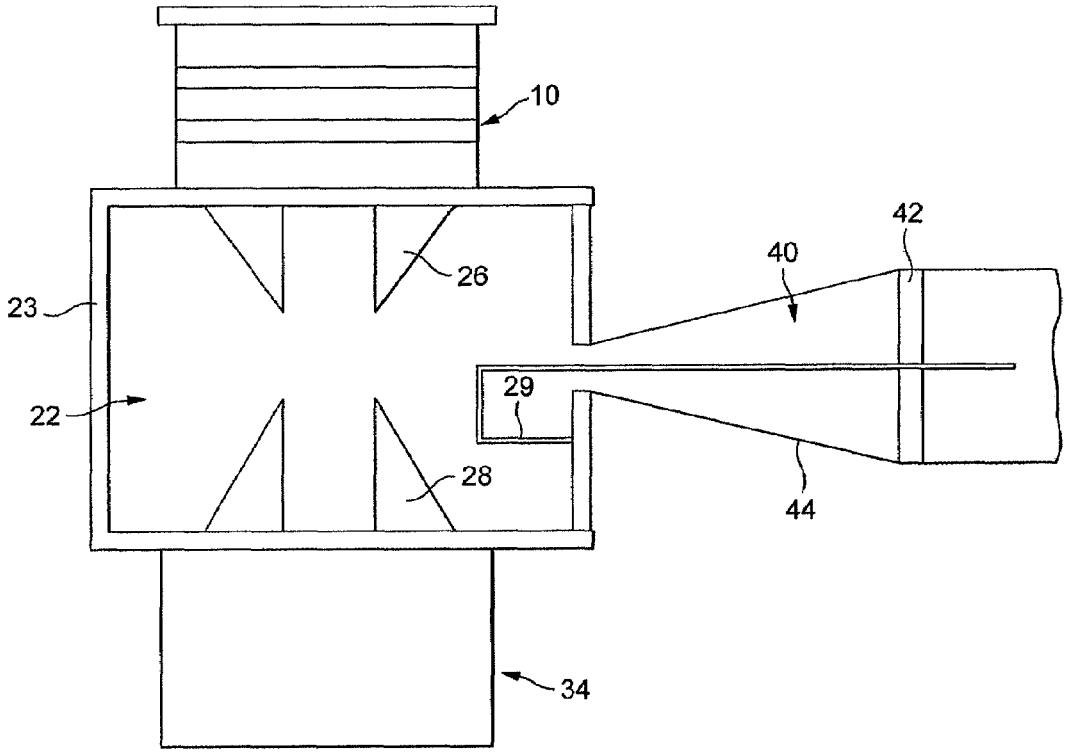
FIG. 2 (PRIOR ART)
FIG. 2: shows an integral cavity arrangement of an Inductive Output Tube.

The output arrangement shown in FIG. 1 is an external output cavity 24. An alternative cavity arrangement, for use with which the invention is particularly beneficial, is an integral output cavity shown in FIG. 2. In this arrangement, an electron gun 10 and collector 34 are arranged as before, but now the interaction region comprises the drift tube 22 with an integral output cavity including a vacuum which extends into fixed sidearm 44. The vacuum envelope is defined by the drift tube 22, including a first drift tube portion 26 and a second drift tube portion 28, and integral output cavity and sidearm volume 40. The output coupling loop 29 extends into the drift tube cavity 22. The output cavity is thus integral with the drift tube cavity. In such arrangements it is usual for the sidearm 44 to be non-removably fixed to the outer wall 23 of the drift tube cavity. The vacuum envelope is closed by a ceramic disc 42 forming an RF window.

Figure 3:
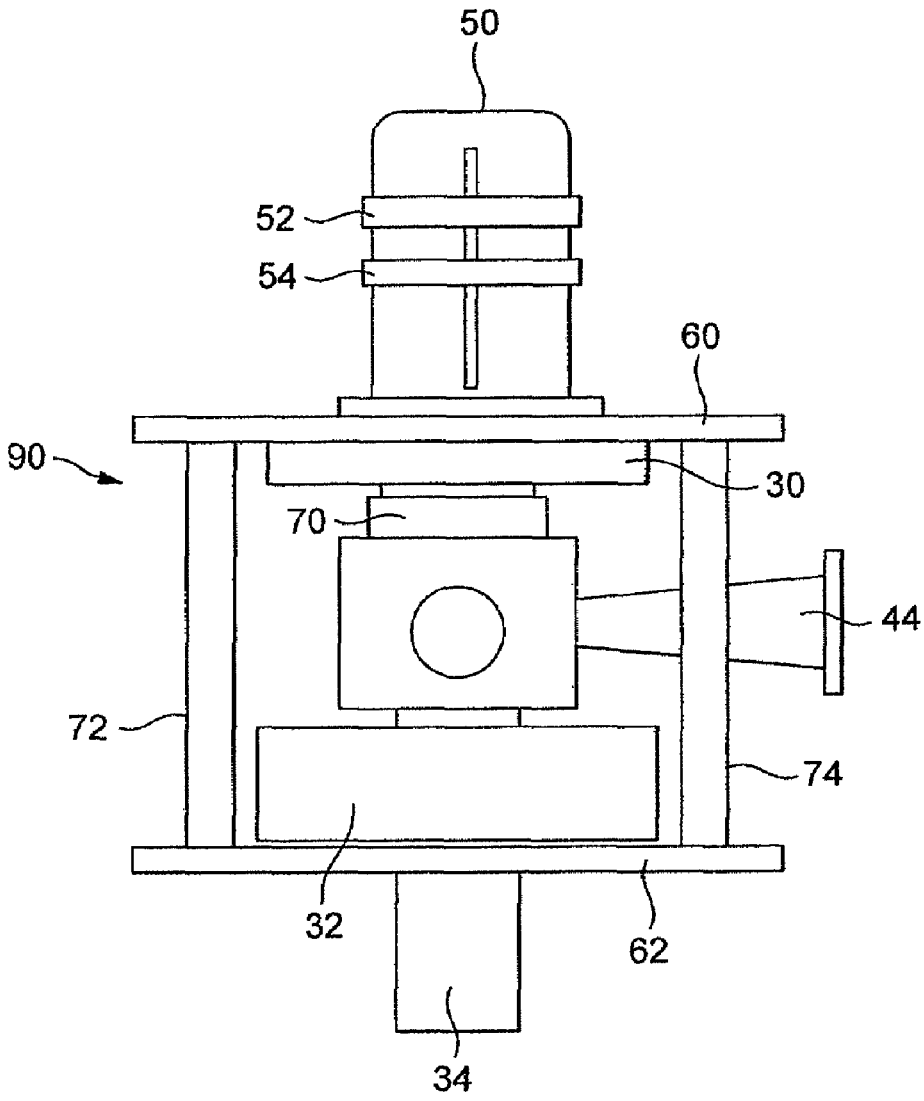
FIG. 3 (PRIOR ART)
FIG. 3: shows a prior art Inductive Output Tube including assembled magnetic assembly.
Figure 4:
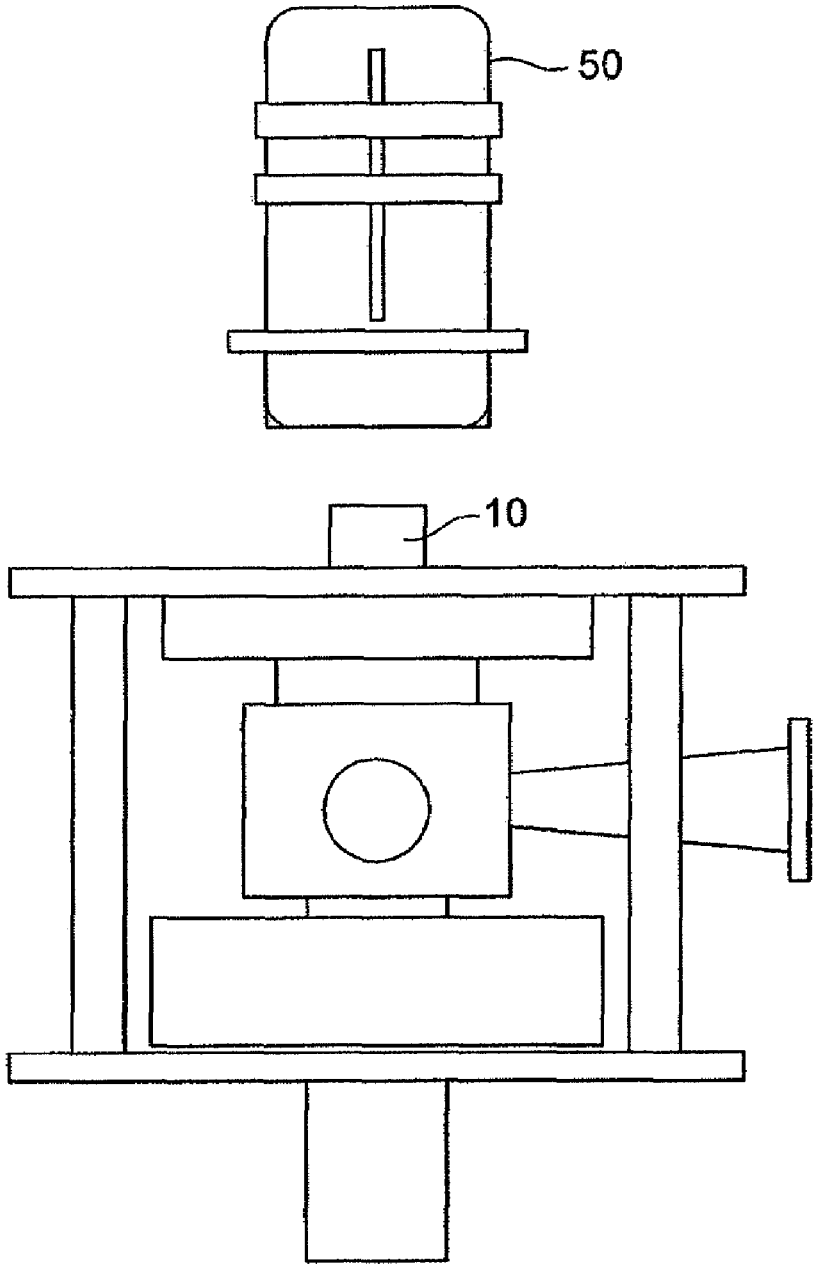
FIG. 4 (PRIOR ART)
FIG. 4: shows the prior art arrangement of FIG. 3 with the input cavity removed.
Figure 5:
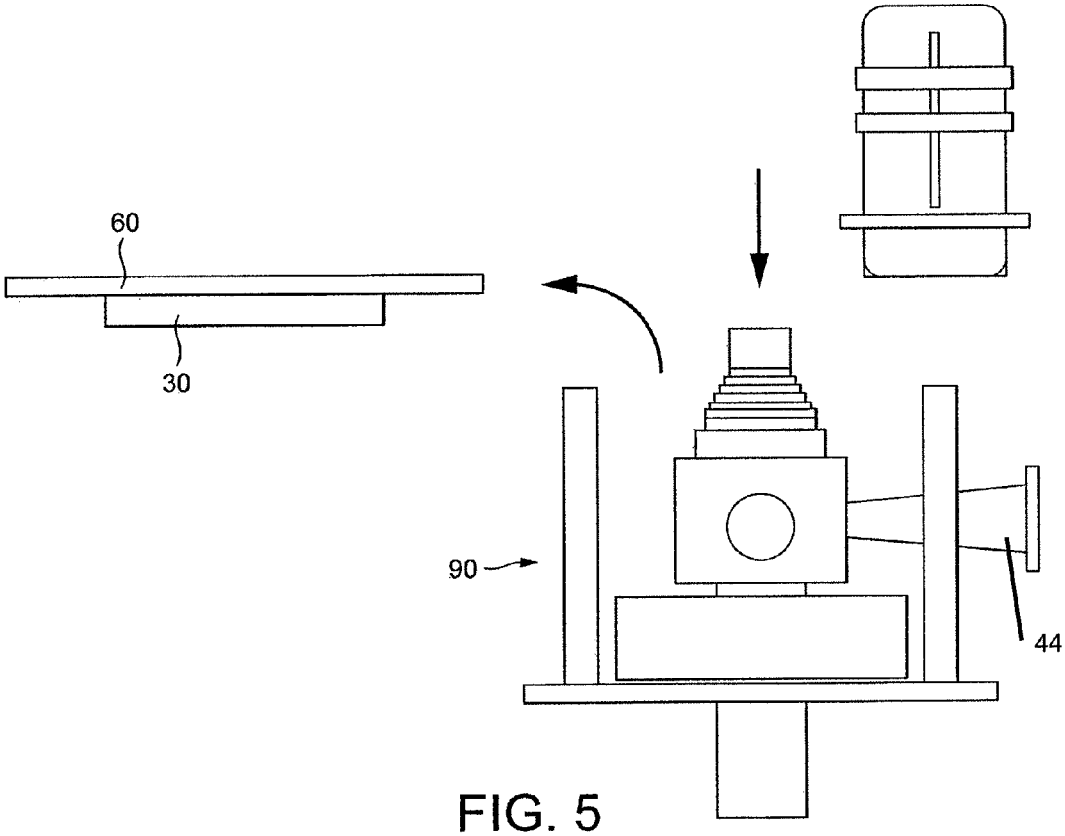
FIG. 5 (PRIOR ART)
FIG. 5: shows the prior art arrangement of FIG. 3 with the top plate removed.

A prior art electron beam tube device including a magnetic assembly is shown in FIGS. 3, 4 and 5. This sequence of figures shows the known technique for removing the body of a beam tube from the magnetic assembly. The electron beam tube comprises an input cavity 50 (FIGS. 3 and 4) with input tuning rings 52, 54 (FIG. 3) mounted on a top plate 60 (FIGS. 3 and 5) of a magnetic assembly. A beam tube body 70 houses an integral output cavity and is connected to an integral output feeder in the form of a sidearm 44. The purpose of the sidearm 44, as shown in FIG. 3, is to couple energy from the output loop 29 (e.g. see FIG. 2) within the beam tube body 70 to an output waveguide. The beam tube body 70 is connected to a collector 34 (FIG. 3), which collects the spent electron beam.

The beam tube body containing the integral output cavity is located within a magnetic field created by a magnetic assembly. The magnetic assembly comprises a top coil 30 (FIGS. 3 and 5) attached to a top plate 60 and a bottom coil 32 attached to a bottom plate 62, as shown in FIG. 3. The top plate 60 and bottom plate 62 are connected by support posts 72, 74 at either side, as shown in FIG. 3. Typically, there are four such support posts, one at each corner of the square top and bottom plates. The support posts serve the function of providing a frame to support the top plate with input cavity on top. The support posts also provide the function of a magnetic return path. The magnetic field generated by the coils has a path down the center of the beam tube body and then a return path through the bottom plate, support posts and top plate. The top and bottom plates and support posts thus form a magnetic frame 90 (FIGS. 3 and 5).

Figure 6:
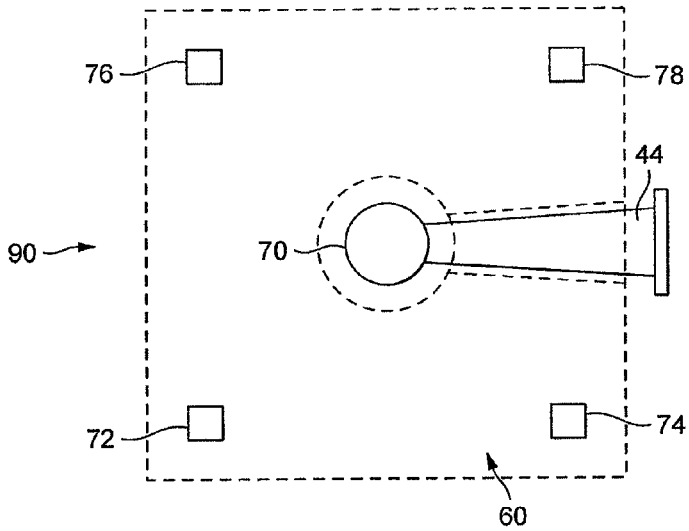
FIG. 6 (PRIOR ART)
FIG. 6: shows a schematic plan view of the magnetic frame of FIG. 5.

The electron beam tube of FIG. 3 is shown in FIG. 4 with the input cavity 50 removed, revealing the electron gun 10. In FIG. 5, the same electron beam tube is now shown with the top plate 60 and top coil 30 removed to allow access to, and removal of, the beam tube body with the feeder 44 and collector attached. The top plate is removed by unscrewing bolts, which secure the plate to the support posts. The top coil is connected by various electrical leads (not shown) and these must typically be removed prior to removal of the top plate. The reason for removal of the top plate 60 can be seen with reference to FIG. 6 which shows a plan view of the arrangement of FIG. 5 with the top plate shown in dashed outline. The sidearm 44 is impeded from removal by the top plate 60. The top plate thus has to be moved to allow any component larger than the inner diameter of the top coil to pass. The magnetic frame 90 is shown in schematic plan view in FIG. 6 showing the four support posts 72, 74, 76, 78 and beam tube body 70 and sidearm 44 within the frame and below top plate 60.

Figure 7:
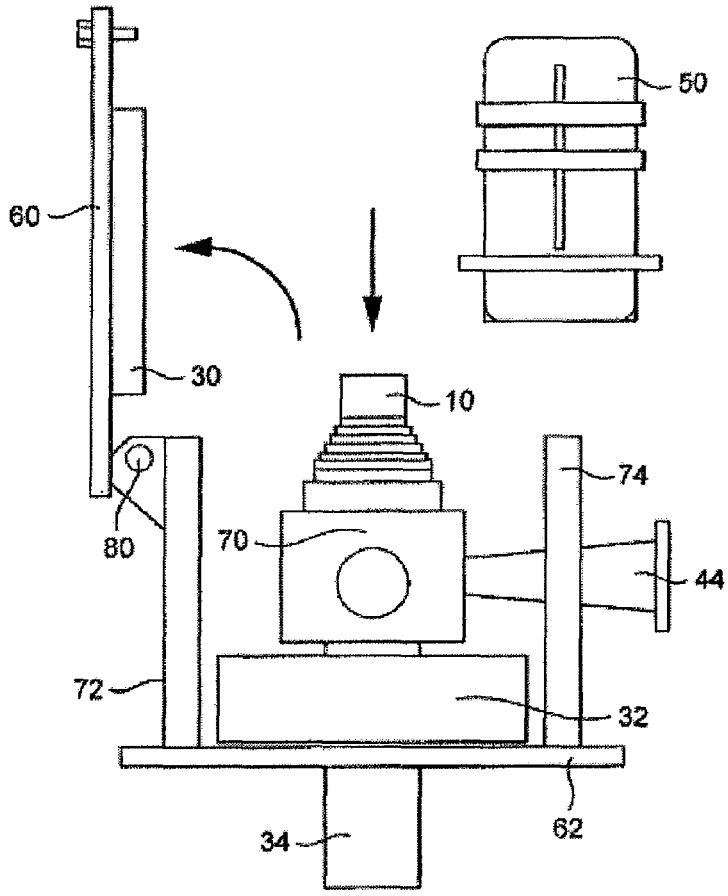
FIG. 7: shows an Inductive Output Tube including a magnetic assembly embodying the invention.

The embodiment of the invention is shown in FIG. 7 and comprises the same components as previously described and so the same numbering is used for simplicity. The earlier general description of an IOT in relation to FIG. 1 applies equally to the present embodiment and so is not repeated here. The embodiment is an integral cavity IOT, though as previously noted, the invention is equally applicable to other electron beam tube devices. The IOT system comprises an input cavity 50 (shown as removed) which provides an input signal to electron gun 10 which creates an electron beam passing into an interaction region within the beam tube body 70 which provides an output signal through an integral output cavity to an output feeder 44 before the spent electron beam is dissipated by a collector 34. The whole beam tube is located within a magnetic frame defined by top and bottom plates 60, 62 which support top and bottom magnets 30, 32. The magnetic field is generated by the magnets in the form of coils 30, 32 and a return path defined by the posts 72, 74 of the frame (in practice there are four such support arms as in FIG. 6, but two are shown in this schematic view).

The embodiment additionally comprises a hinge assembly arranged such that the top plate (with top magnetic coil attached) can pivot away from the electron gun 10 and beam tube body 70 thereby giving access to install or remove the electron gun and beam tube assembly with the output feeder 44 still fixed to the beam tube body 70. The output feeder is no longer impaired by the top coil 30 or top plate 60. This arrangement has a number of advantages. First, the top plate and top coil are maintained in a defined position relative to the remainder of the magnetic circuit so that, when pivoting back to be placed over the electron gun, the top plate is in correct registration, thus putting the top coil into the correct position. This ensures that the coil is correctly located to focus the electron beam. A typical tolerance of less than 1 mm is needed in an overall dimension of the magnetic frame of around 30 cm. Second, the electrical leads connected to the coils do not need to be disconnected prior to pivoting of the top plate, unlike the prior art, which required complete removal of the top plate.

The pivoting arrangement could take various forms provided that the top plate has sufficient room to clear the top of the beam tube body, in this case including the electron gun. The preferred arrangement has a hinge assembly which comprises two hinges 80, one at each of two corners of the top plate attaching the top plate to each of two of the four frame support posts (two shown as 72, 74).

Figure 8:
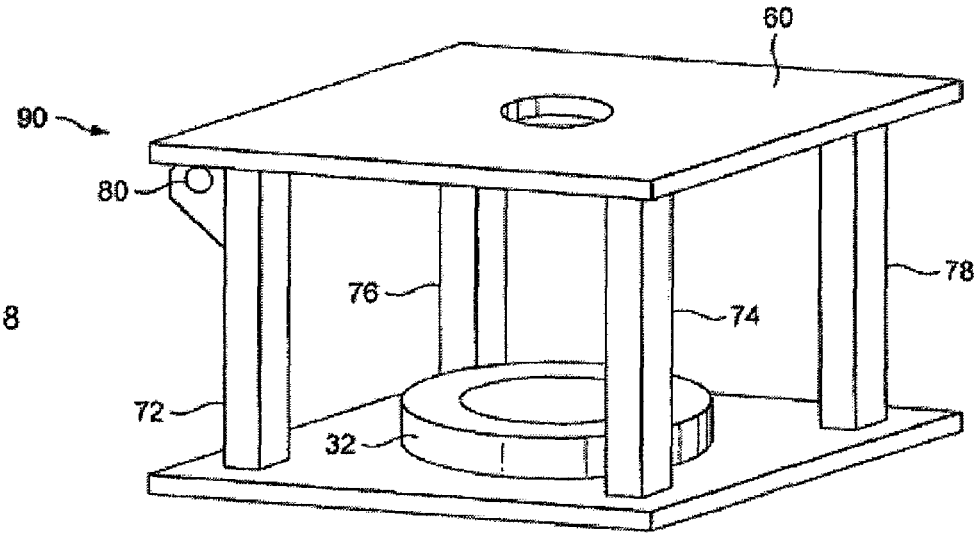
FIG. 8: shows a schematic perspective view of the magnetic frame of FIG. 7.

A perspective schematic view of the magnetic frame 90 alone is shown in FIG. 8 showing the four support posts 72, 74, 76, 78, the bottom magnet 32 and the top plate 60 hinged by hinges 80.

As shown in FIGS. 7 and 8, the top plate and attached coil are pivotable with respect to the remainder of the electron beam tube device, in particular with respect to the electron beam tube itself between two positions. In the closed position, the top plate and coil pass over the top part of the electron beam tube. In the open position, the top plate and coil are away from the electron beam tube allowing the beam tube body and output feeder to be removed without impediment.

The invention is applicable to pivoting other parts of the magnetic frame in such a way that the beam tube body and any integral components can be removed without allowing unwanted particles to accumulate on the magnetic frame. For example, one alternative would be to pivot the bottom plate in some arrangements.

What is claimed is:

1. An electron beam tube device, comprising: a magnetic frame including a cavity arrangement within the magnetic frame, the magnetic frame comprising a magnetic source and a support frame, wherein a part of the magnetic frame is pivotably mounted to be pivotable with respect to the remainder of the magnetic frame to allow insertion or removal of the electron beam tube.

2. An electron beam tube device according to claim 1, wherein the part of the magnetic frame that is pivotably mounted is a top plate.

3. An electron beam tube device according to claim 1, wherein the part of the magnetic frame that is pivotably mounted includes at least a part of the magnetic source.

4. An electron beam tube device according to claim 3, wherein at least part of the magnetic source is a magnetic coil.

5. An electron beam tube device according to claim 1, wherein the cavity arrangement includes an integral output cavity and output feeder, wherein the electron beam tube is insertable into and removeable from the magnetic frame independent of removal of the output feeder.

6. An electron beam tube device according to claim 1, wherein the part of the magnetic frame that is pivotably mounted is pivotable so that the part moves between a closed position in which the part encompasses a longitudinal axis of the electron beam tube and an open position in which the part is away from the longitudinal axis.

7. An electron beam tube device according to claim 1, wherein the electron beam tube device is an Inductive Output Tube device.

8. An electron beam tube device according to claim 1, wherein the part of the magnetic frame is pivotable between a closed position covering the electron beam tube and an open position away from the electron beam tube.

9. A magnetic frame for an electron beam tube, comprising a magnetic frame including a cavity arrangement within the frame, the magnetic frame comprising a magnetic source and a support frame, wherein a part of the magnetic frame is pivotably mounted to be pivotable away from the cavity arrangement thereby allowing insertion or removal of the electron beam tube.

10. A magnetic frame according to claim 9, wherein the part of the magnetic frame that is pivotably mounted includes a magnetic source.

11. A magnetic frame according to claim 10, wherein the magnetic source comprises a magnetic coil.

12. A magnetic frame according to claim 9, wherein the part of the magnetic frame that is pivotably mounted is a top plate.

13. A magnetic frame according to claim 9, wherein the part of the magnetic frame is pivotable between a closed position covering the electron beam tube and an open position away from the electron beam tube.

* * * * *

UNITED STATES PATENT AND TRADEMARK OFFICE

CERTIFICATE OF CORRECTION

PATENT NO. : 7,579,779 B2
APPLICATION NO. : 11/352404
DATED : August 25, 2009
INVENTOR(S) : Stuart William Andrews It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 765 days.

Signed and Sealed this

Fourteenth Day of September, 2010

David J. Kappos

David J. Kappos
*Director of the United States Patent and Trademark Office*